US005409880A

United States Patent [19]

Itabashi et al.

[11] Patent Number: 5,409,880

[45] Date of Patent: Apr. 25, 1995

[54] MULTI-COLOR HEAT-SENSITIVE RECORDING MATERIAL

[75] Inventors: Yuichi Itabashi; Akira Igarashi, both of Shizuoka, Japan

[73] Assignee: Fuji Photo Film Co., Ltd., Kanagawa, Japan

[21] Appl. No.: 62,549

[22] Filed: May 18, 1993

[30] Foreign Application Priority Data

May 19, 1992 [JP] Japan ..... 4-152872

[51] Int. Cl.[6] ..... B41M 5/30; B41M 5/34; B41M 5/40

[52] U.S. Cl. ..... 503/204; 427/152; 503/200; 503/214; 503/226

[58] Field of Search ..... 427/152; 503/200, 204, 503/226, 214

[56] References Cited

U.S. PATENT DOCUMENTS 4,311,750 1/1982 Kubo et al. ..... 428/212

FOREIGN PATENT DOCUMENTS 4-35986 2/1992 Japan ..... 503/226

*Primary Examiner*—B. Hamilton Hess

*Attorney, Agent, or Firm*—Sughrue, Mion, Zinn, Macpeak & Seas

[57] ABSTRACT

A multi-color heat-sensitive recording material which comprises a support having thereon at least two heat-sensitive recording layers, each of which comprises a colorless or pale-color color forming agent which forms a color by heating, a color developer and a binder, an intermediate layer being incorporated between the two heat-sensitive recording layers and the intermediate layer comprising at least gelatin and/or a gelatin derivative and polyvinyl pyrrolidone and/or a polyvinyl pyrrolidone derivative, with the polyvinylpyrrolidone and/or the polyvinylpyrrolidone derivative having an average molecular weight of not more than 160,000, the content of which ranges from 1 to 20 percent by weight based on the weight of the gelatin and/or gelatin derivative.

7 Claims, No Drawings

MULTI-COLOR HEAT-SENSITIVE RECORDING MATERIAL

FIELD OF THE INVENTION

The present invention relates to multi-color heat-sensitive recording materials and, more particularly, it relates to multi-color heat-sensitive recording materials which are favorably produced, and which exhibit excellent color separation and enhanced preservability when the materials are stored under high temperature and humidity conditions.

BACKGROUND OF THE INVENTION

In recent years, due to remarkable developments in the art, the heat-sensitive recording method has been widely used in various applications since it has a high reliability, even when implemented in compact recording devices (whose maintenance is free). Various attempts have since been proposed which make it possible to provide multi-colored or full-colored images recorded by the heat-recording.

In general, when the heat-sensitive recording materials are to be used in multi-colored records (as a result of heat recording), the heat-sensitive recording material is applied to the multi-colored records as electron donating dye precursors (for color forming agents) and electron accepting compounds (for color developers), or diazo compounds (for color forming agents) and coupling components (for color developers), which each produces different hues due to the varying levels of the thermal energy applicable thereto (known as color separation).

Such materials are produced by providing on the support the heat-sensitive recording layers in superposition by coating to secure the multilayers (which establish different hues produced by different manners in color formation upon heat-recording). These multi-color heat-sensitive recording materials can suffer from the disadvantage of the color mixing phenomenon or reduced heat-sensitivity due to the fact that the heat-sensitive recording layers thereof become mixed with each other when the layers are provided in superposition by coating, or due to the color forming components or sensitizers diffusing between the respective layers to become miscible after the layers are provided in superposition by coating. To avoid such disadvantages, intermediate layers comprising water-soluble macromolecules as the main constituents are conventionally provided to improve the color separation. Such separation permits one to specify the color forming layer depending on the level of thermal energy applicable thereto. Although the intermediate layers introduce beneficial effects in the color separation and/or in avoiding the diffusion associated therewith, the intermediate layers, disadvantageously, make it complex to produce the multi-color heat-sensitive recording materials.

Thus, the present inventors have already proposed intermediate layers comprising gelatin or gelatin derivatives as the main constituents together with binders contained in the heat-sensitive recording layers to obtain the multi-color heat-sensitive recording materials which are suitable for favorable production. This was done by providing the heat-sensitive recording layers in superposition by coating. As a result, this embodiment satisfactorily avoided the diffusion of the color forming components between the respective layers (e.g., see JP-A-4-35986, wherein the term "JP-A", as used herein, means an "unexamined published Japanese patent application").

However, even such multi-color heat-sensitive recording materials still have the further defect(s) of color-mixing or desensitization due to the diffusion which still exists. This is true because the diffusion of the color forming components between the recording layers cannot completely be avoided (insufficient effect of avoiding the diffusion) when the materials are stored under high temperatures and humid conditions (in view of preservability which means resistance to heat and humidity). When substances known as those typically having an effect in avoiding diffusion are incorporated into such intermediate layers comprising gelatin as the main constituent, such embodiments are prone to additional problems. For example, the resulting coating liquids in these embodiments are of poor stability, which is unsuitable for the favorable production of the multi-color heat-sensitive recording materials. This is true because an interaction between the above-mentioned substances and the gelatin contained therein occurs, which causes the gelatin to become an aggregate or gel.

SUMMARY OF THE INVENTION

The present inventors have made intensive studies in order to obviate the defects described above. As a result, they have found that heat-sensitive recording materials can be obtained which provide marked improvement in raw stock storability when the materials are stored under high temperature and humidity conditions, and which are suitable for favorable production when the materials have intermediate layers which contain a predetermined amount of polyvinyl pyrrolidone and/or polyvinyl pyrrolidone derivatives in addition to gelatin and/or gelatin derivatives. The present invention has been accomplished based on these findings.

Thus, an object of the present invention is to provide a multi-color heat-sensitive recording material which provides improved raw stock storability when the material is stored under high temperature and humidity conditions, and which is suitable for favorable production.

This and other objects of the present invention have been achieved by a multi-color heat-sensitive recording material comprising a support having thereon at least two heat-sensitive recording layers, each of which comprises a colorless or pale-color color forming agent which forms color by heating, a color developer, and a binder. An intermediate layer is incorporated between the two heat-sensitive recording layers, and the intermediate layer comprises gelatin and/or a gelatin derivative and polyvinyl pyrrolidone and/or a polyvinyl pyrrolidone derivative. The polyvinyl pyrrolidone and/or polyvinyl pyrrolidone derivative have/has an average molecular weight of not more than 160,000, and are/is present in an amount of from 1 to 20 percent by weight based on the weight of the gelatin and/or the gelatin derivative.

DETAILED DESCRIPTION OF THE INVENTION

Components which may be used in providing the multi-color heat-sensitive recording materials according to the present invention are explained below.

Colorless or pale color color forming agents and color developers which can be used in the multi-color heat-sensitive recording materials of the present invention are substances which cause a color forming reaction by heating when they come in contact with each other. Specific examples of combinations of color forming agents and color developers include combinations of electron donating dye precursors (for color forming agents) and electron accepting compounds (for color developers), or combinations of diazo compounds (for color forming agents) and couplers (for color developers).

Examples of electron donating dye precursors include triarylmethane-based compounds, diphenylmethane-based compounds, thiazine-based compounds, xanthane-based compounds and spiropyran-based compounds. Triarylmethane-based compounds and xanthene-base compounds are particularly favorable because of high color density obtained thereby. Specific examples thereof include 3,3-bis(p-dimethylaminophenyl)-6-dimethylaminophthalide (referred to as crystal violet lactone), 3,3-bis(p-dimethylamino)phthalide, 3-(p-dimethylaminophenyl)-3-(1,3-dimethylindole-3-yl)phthalide, 3-(p-dimethylaminophenyl)-3-(2-dimethylindole-3-yl)phthalide, 3-(o-methyl-p-dimethylaminophenyl)-3-(2-methylindole-3-yl)phthalide, 4,4'-bis(dimethylamino)benzhydrylbenzylether, N-halophenylleucoauramine, N-2,4,5-trichlorophenylleucoauramine, rhodamine-B-anilinolactam, rhodamine (p-nitroanilino)lactam, rhodamine-B-(p-chloroanilino)-lactam, 2-benzylamino-6-diethylaminofluoran, 2-anilino-6-diethylaminofluoran, 2-anilino-3-methyl-6-diethylaminofluoran, 2-anilino-3-methyl-6-cyclohexylmethylaminofluoran, 2-anilino-3-methyl-6-isoamylethylaminofluoran, 2-(o-chloroanilino)-6-diethylaminofluoran, 2-octylamino-6-diethylaminofluoran, 2-ethoxyethylamino-3-chloro-2-diethylaminofluoran, 2-anilino-3-chloro-6-diethylaminofluoran, benzoylleucomethylene blue, p-nitrobenzylleucomethylene blue, 3-methyl-spiro-dinaphthopyran, 3-ethyl-spiro-dinaphthopyran, 3,3'-dichloro-spiro-dinaphthopyran, 3-benzyl-spiro-dinaphthopyran, 3-propyl-spiro-dibenzopyran, etc.

Examples of electron accepting compounds include phenol derivatives, salicylic acid derivatives and esters of hydroxybenzoic acid. Among them, bisphenols and esters of hydroxybenzoic acid are particularly preferred. Examples of bisphenols and esters of hydroxybenzoic acid include 2,2-bis(p-hydroxyphenyl)propane (known as bisphenol A), 2,2-bis(p-hydroxyphenyl)pentane, 2,2-bis(p-hydroxyphenyl)ethane, 2,2-bis(p-hydroxyphenyl)butane, 2,2-bis(4'-hydroxy-3',5'-dichlorophenyl)propane, 1,1-(p-hydroxyphenyl)cyclohexane, 1,1-(p-hydroxyphenyl)propane, 1,1-(p-hydroxyphenyl)-pentane, 1,1-(p-hydroxyphenyl)-2-ethylhexane, 3,5-di(α-methylbenzyl)salicylic acid or its polyvalent metallic salts, 3,5-di(tert-butyl)salicylic acid or its polyvalent metallic salts, 3-α,α-dimethylbenzylsalicylic acid or its polyvalent metallic salts, butyl p-hydroxybenzoate, benzyl p-hydroxybenzoate, 2-ethylhexyl p-hydroxybenzoate, p-phenylphenol and p-cumylphenol.

Sensitizers may preferably be added to the heat-sensitive recording layers comprising electron donating dye precursors and electron accepting compounds in combination in order to accelerate the reaction therebetween. As such sensitizers, organic compounds are preferable which have a low melting point and suitably contain an aromatic group and a polar group within the molecules. Specific examples of such sensitizers include benzyl p-benzyloxybenzoate, α-naphthyl benzyl ether, β-naphthyl benzyl ether, β-naphthoic acid phenyl ester, α-hydroxy-β-naphthoic acid phenyl ester, β-naphthol-(p-chlorobenzyl)ether, 1,4-butanediol phenylether, 1,4-butanediol-p-methylphenyl ether, 1,4-butanediol-p-ethylphenylether, 1,4-butanediol-m-methylphenylether, 1-phenoxy-2-(p-tolyloxy)ethane, 1-phenoxy-2-(p-ethylphenoxy)ethane, 1-phenoxy-2-(p-chlorophenoxy)ethane and p-benzylbiphenyl.

Further, known photolytic diazo compounds, couplers which react with the diazo compounds to form a dye, and, as necessary, basic substances which accelerate the reaction between the diazo compounds and the couplers, can be used for the heat-sensitive recording layers. The photolytic diazo compounds referred to in the present invention mainly involve aromatic diazo compounds. Specific examples thereof include aromatic diazonium salts, diazosulfonate compounds and diazoamino compounds. Of them, the diazonium salts are particularly preferable from the viewpoint of heat-sensitivity. The diazonium salts are compounds represented by the general formula $Ar—N_2^+X^-$ (wherein Ar refers to an aromatic group, $N_2^+$ to a diazonium salt, and $X^-$ to an anion of acid). These compounds have a variety of the maximum absorption wavelengths depending upon the position and kind of the substituent on the Ar group.

Specific examples of diazo compounds which may be used in the present invention include 4-(N-(2-(2,4-di-tert-amylphenoxy)butyryl)piperazino)benzenediazonium, 4-dioctylamonobenzenediazonium, 4-(N-(2-ethylhexanoyl)piperazino)benzenediazonium, 4-dihexylamino-2-hexyloxybenzenediazonium, 4-N-ethyl-N-hexadecylamino-2-ethoxybenzenediazonium, 3-chloro-4-dioctylamino-2-octyloxybenzenediazonium, 2,5-dibutoxy-4-morpholinobenzenediazonium, 2,5-octoxy-4-morpholinobenzenediazonium, 2,5-dibutoxy-4-(N-(2-ethylhexanoyl)piperazino)benzenediazonium, 2,5-diethoxy-4-(N-(2-(2,4-di-tert-amylphenoxy)butyl)-piperazino)benzenediazonium, 2,5-dibutoxy-4-tolylthiobenzenediazonium, 3-(2-octyloxyethoxy)-4-morpholinobenzenediazonium, etc. As these salts, in the present invention, hexafluorophosphates, tetrafluoroborates and 1,5-naphthalenesulfonates are particularly favorable because they are of low solubility in water but are soluble in organic solvents.

As couplers (which undergo reaction with the diazo compounds on heating to produce color) to be used in the present invention, examples include resorcin, phloroglucin, sodium 2,3-dihydroxynaphthalene-6-sulfonate, 1-hydroxy-2-naphthoic morpholinopropylamide, 1,5-dihydroxynaphthalene, 2,3-dihydroxynaphthalene, 2,3-dihydroxy-6-sulfanilnaphthalene, 2-hydroxy-3-naphthoic anilide, 2-hydroxy-3-naphthoic ethanolamide, 2-hydroxy-3-naphthoic octylamide, 2-hydroxy-3-naphthoic-N-dodecyloxypropylamide, 2-hydroxy-3-naphthoic tetradecylamide, acetanilide, acetoacetanilide, benzoylacetanilide, 2-chloro-5-octylacetoacetanilide, 1-(2-tetradecanoxyphenyl)-2-carboxymethylcyclohexane-3,5-dione, 1-phenyl-3-methyl-5-pyrazolone, 1-(2'-octylphenyl)-3-methyl-5-pyrazolone, 1-(2',4',6'-trichlorophenyl)-3-benzamido-5-pyrazolone, 1-(2',4',6'-trichlorophenyl)-3-anilino-5-pyrazolone, 1-phenyl-3-phenylacetamido-5-pyrazolone, etc. Two or more of such couplers may be used in combination.

In the present invention, basic substances may be used which enhance the reaction between diazonium salts and couplers. Such basic substances include compounds which undergo decomposition on heating to release alkaline substances, in addition to inorganic or basic compounds. Representative examples thereof of include nitrogen containing compounds such as organic ammonium salts, organic amines, amides, ureas or thioureas or derivatives thereof, thiazoles, pyrroles, pyrimidines, piperazines, guanidines, indoles, imidazoles, imidazolines, triazoles, morpholines, piperazines, amidines, formamidines, pyridines, etc.

Specific examples of such basic substances include tricyclohexylamine, tribenzylamine, octadecylbenzylamine, stearylamine, allylurea, thiourea, methylthiourea, allylthiourea, ethylenethiourea, 2-benzylimidazole, 4-phenylimidazole, 2-phenyl-4-methylimidazole, 2-undecylimidazoline, 2,4,5-trifuryl-2-imidazoline, 1,2-diphenyl-4,4-dimethyl-2-imidazoline, 2-phenyl-2-imidazoline, 1,2,3-triphenylguanidine, 1,2-dicyclohexylguanidine, 1,2,3-tricyclohexylguanidine, guanidine trichloroacetate, N,N'-dibenzylpiperazine, 4,4'-dithiomorpholine, morpholinium trichloroacetate, 2-aminobenzothiazole, 2-benzoylhydrazinobenzothiazole, etc. Two or more of such basic substances may be used in combination.

In the present invention, it is possible to use color forming agents and color developers in the form of a solid dispersion. The solid dispersion is obtained by dispersing the color forming agents and color developers using an aqueous solution of water-soluble macromolecules, followed by coating and drying. However, the color forming agents may advantageously be used in the form of microcapsules under the following circumstances. When the color forming agents are encapsulated for use in heat-sensitive recording layers, the agents are prevented from coming in contact with the color developers present therein at ordinary temperatures, enhancing raw stock storability (for background antifogging) of the heat-sensitive recording layers when they are stored, and enabling the control of color forming sensitivity (so as to produce a color by the action of the desired thermal energy applied thereto on heat-recording).

In order to produce microcapsules which can be used in the present invention, any one of an interfacial polymerization method, an internal polymerization or an external polymerization may be used. But the interfacial polymerization method is particularly preferred herein. In such a preferred method, core substances containing color forming agents as either dispersed or dissolved by a non-aqueous solvent are emulsified in the aqueous solution of water-soluble macromolecules first and then a wall of the macromolecules is formed around the oil droplets. A reactant (to form the macromolecules) is added to the inside and/or outside of the oil droplets.

Examples of the macromolecular substances include polyurethane, polyurea, polyamide, polyester, polycarbonate, urea-formaldehyde resin, melamin resin, polystyrene, styrene-methacrylate copolymer and styrene-acrylate copolymer. Of these macromolecular substances, preferred are polyurethane, polyurea, polyamide, polyester and polycarbonate and, more particularly, preferred are polyurethane and polyurea. Two or more of such macromolecular substances may be used in combination. Specific examples of water-soluble macromolecules as described above include gelatin, polyvinyl pyrrolidone and polyvinyl alcohol.

For example, when polyurea is intended to be in use for capsule wall material, the microcapsule wall may readily be formed by the interfacial polymerization method using a non-aqueous solvent, in which the polymerization reaction occurs between a polyisocyanate such as diisocyanate, triisocyanate, tetraisocyanate or polyisocyanateprepolymer, and a polyamine such as diamine, triamine or tetramine. The prepolymer contains at least two amino groups, piperazine or its derivative or a polyol.

The capsule walls may also be composite walls in the present invention. The composite walls, such as those consisting of polyurea and polyamide or polyurethane and polyamide, may be formed by using, for example, polyisocyanates and acid chlorides or polyamines and polyols, in such a way that an emulsified reaction liquid containing such reactants as described above is subjected to pH-adjustment first and then heated. A detailed description of methods for producing such composite walls consisting of polyurea and polyamide is given in British Patent 2,107,480A(B).

To make microcapsule walls swollen on heating, solid sensitizers may further be added thereto in the present invention. The solid sensitizers for use therein are plasticizers for polymers which are used in microcapsule walls to give them a melting point of not less than 50° C., and preferably of not more than 120° C., and which are solids at ordinary temperature. For example, when the wall material comprises polyurea or polyurethane, suitable examples of solid sensitizers include hydroxyl compounds, carbamic acid esters, aromatic alkoxy compounds, organic sulfonamides, aliphatic amides or aryl amides.

In the present invention, color forming aids may also be employed. The color forming aids for use in the present invention are substances which can make the color density higher in heat-recording or can lower the minimum coloring temperature. The color forming aids also facilitate the reaction of the diazo compounds, basic substances and coupling components by lowering the melting point of the color forming agents and color developers or by lowering the softening point of the capsule wall. The color forming aids for use in the present invention include phenol compounds, alcoholic compounds, amide compounds and sulfonamide compounds. Specific examples thereof include p-tert-octylphenol, p-benzyloxyphenol, phenyl p-oxybenzoate, carbanilic acid benzyl ester, carbanilic acid phenethyl ester, hydroquinone dihydroxyethyl ether, xylylenediol, N-hydroxyethyl-methanesulfonamide or N-phenylmethanesulfonamide. These compounds may be either included in the core substances or added to the outside of the microcapsules as emulsified dispersive substances.

In the present invention, substantially transparent heat-recording layers for forming a color can be provided to obtain multi-color images of enhanced quality. In this case, electron accepting dye precursors as color forming agents or color developers to diazo compounds can be used by dispersing them not in a solid form but in an emulsified dispersion form (after dissolving them in an organic solvent which is slightly soluble or insoluble in water) and then mixing the resulting organic solution with an aqueous phase containing a surface active agent and/or water-soluble macromolecules as a protective colloid. The surface active agent is preferably used to easily obtain an emulsified dispersion. The organic solvents to be used in this case can be chosen from oils with a high boiling point such as those described in, for example, JP-A-2-141279. Of these organic solvents, preferred are esters in view of the emulsion stability of the resulting dispersed emulsion. Further, a particularly preferred organic solvent is tricresyl phosphate, used either alone or mixed. When tricresyl phosphate is used, extremely satisfactory stability of the dispersed emulsion of color developers is obtained. Combinations of the above-described oils or of the above-described oils with other oils are also suitable.

In the present invention, auxiliary solvents may be added to the above-mentioned organic solvents as dissolution aids with a low boiling point. Particularly preferable examples of such auxiliary solvents include ethyl acetate, isopropyl acetate, butyl acetate or methylene chloride. Only the auxiliary solvents free from oils having a high boiling point may be used.

The water-soluble macromolecules which are for use in the protective colloid involved in the aqueous phase (as mixed with an oil phase containing the above-mentioned components) may suitably be chosen from known anionic macromolecules, nonionic macromolecules or amphoteric macromolecules. Preferable examples thereof include polyvinyl alcohol, gelatin or cellulose derivatives.

The surface active agents which are contained in the aqueous phase may suitably be chosen from anionic or nonionic surface active agents which interact with the above-described protective colloid to cause minimal precipitation or aggregation therein. Preferred examples of the surface active agents include sodium alkylbenzenesulfonate, sodium alkylsulfate, sodium dioctylsulfosuccinate or polyalkylene glycol (such as polyoxyethylene nonylphenyl ether).

The dispersed emulsions of the present invention may be readily prepared by mixing and dispersing the oil phase containing the above-mentioned components and the aqueous phase containing the protective colloid and the surface active agent by any typical means for emulsification of ordinary fine particles (such as high-speed agitation or ultrasonic dispersion). Moreover, the ratio of the oil phase to the aqueous phase (in weight) is preferably from 0.02 to 0.6 and, more particularly, from 0.1 to 0.4. A ratio of less than 0.02 will not produce a satisfactory color due to excess dilution caused by too much water present while a ratio greater than 0.6 will cause inconveniences in handling and/or poor stability of the coating liquid due to high viscosity of the liquid. When the heat-sensitive recording layers are not required to be transparent, color developers and the like may be used in the form of a solid dispersion (as obtained by a sand mill or the like).

The heat-sensitive recording materials of the present invention contain binders for binding various components such as color forming components on the supports, or the heat-sensitive layers already coated, and intermediate layers. The binders may suitably be chosen from those known. Gelatin and/or gelatin derivatives suitable for use in coating multiple layers in superposition are particularly preferable as the binders. The gelatin which can be used in the present invention is not particularly limited, but one such as alkali processed gelatin or acid processed gelatin, or a gelatin derivative such as modified gelatin in which part of the functional groups present in the gelatin is modified (for example, phthalized gelatin) may be suitable. Gelatin, with the low contents of univalent metal ions or halogen ions, may be preferably in use to prevent the metal corrosion of a thermal head on heat-recording.

In the present invention, two or more kinds of the binders described above may be used in combination. In this case, the content of gelatin present in the binders is preferred to be not less than 50% and, more particularly, not less than 65%. Examples of other binders for use in the present invention include various emulsions such as polyvinyl alcohol, methyl cellulose carboxymethyl cellulose, hydroxypropyl cellulose, arabian gum, polyvinyl pyrrolidone, casein, styrene-butadiene latex, acrylonitrile-butadiene latex, polyvinyl acetate, polyacrylic ester or ethylene-vinyl acetate. The binder is preferably present in an amount of from 0.5 to 5 g/m$^2$ on a dry basis.

In the heat-sensitive recording materials of the present invention, in addition to the above-mentioned components, such acidic stabilizers may be added thereto such as citric acid, tartaric acid, oxalic acid, boric acid, phosphoric acid or pyrophosphoric acid.

In the present invention, protective layers may preferably be provided on the heat-sensitive recording layers. When the protective layers are required to be transparent, the protective layers may preferably comprise silicone-modified polyvinyl alcohol and colloidal silica. When the protective layer is provided on the uppermost heat-sensitive recording layer, it is possible to enhance the mechanical strength of the surface of the heat-sensitive recording layer.

Addition of pigment, metallic soap, wax or crosslinking agents to protective layers is for improvement in matching the protective layers with a thermal head on heat-recording or in the resistance of the protective layers to water. Details of the pigment, metallic soap, wax or cross-linking agents are described, for example, in JP-A-2-141279.

Moreover, to form uniformly protective layers on heat-sensitive recording layers, surface active agents may be added to coating liquids for forming the protective layers. Examples of such surface active agents include alkali metal salts of sulfosuccinic based acids or fluorine-containing surface active agents. Specific examples thereof include sodium or ammonium salts of di-(2-ethylhexyl) sulfosuccinic acid or di-(n-hexyl) sulfosuccinic acid. Further, surface active agents or macromolecular electrolytes for prevention of charged heat-sensitive recording materials may be added to protective layers. The coated amount of a protective layer on a solid basis usually ranges from 0.5 to 5 g/m$^2$, more preferably, from 1 to 3 g/m$^2$. When protective layers are not required to be transparent, known protective layers may suitably be provided thereon.

In the heat-sensitive recording materials in accordance with the present invention, intermediate layers are provided to enhance preservability and thermal separation of the materials. More particularly, to improve preservability when the materials are stored under high temperature and humidity conditions and also suitability for the favorable production of the materials, according to the present invention, intermediate layers comprise at least gelatin and/or gelatin derivatives and polyvinyl pyrrolidone and/or polyvinyl pyrrolidone derivatives.

The above-mentioned gelatin and gelatin derivatives for use in the intermediate layers are the same as those for use in the heat-sensitive recording layers as described above. The average molecular weight of the vinyl pyrrolidone or polyvinyl pyrrolidone derivatives for use therein is to be not more than 160,000 and preferably not more than 50,000.) The above-mentioned polyvinyl pyrrolidone derivatives include copolymers of vinyl pyrrolidone with other monomers. In this case, the content of vinyl pyrrolidone in the copolymer is preferred to be not less than 30 mole %.

Specific examples of such copolymers include copolymers of vinyl pyrrolidone and vinyl acetate (for example, a copolymer of vinyl pyrrolidone and vinyl acetate in a molar ratio of 7 to 3). The amount of the polyvinyl pyrrolidone and/or polyvinyl pyrrolidone derivatives to the gelatin and/or gelatin derivatives which are contained in the intermediate layers is to be from 1 to 20% by weight, and preferably from 3 to 10% by weight. A ratio of less than 1% will not produce the satisfactory preservability of the materials when the materials are stored under high temperatures and humid conditions, while a ratio of more than 20% will not produce a uniform color and will make it difficult to conduct the multiple coating of the layers in superposition, thus resulting in insufficient suitability for the favorable production of the materials. The intermediate layers of the present invention may include binders in addition to the polyvinyl pyrrolidone and gelatin as described above. Examples of the binders as used in combination therewith include emulsions or lattices of hydrophobic macromolecules or water-soluble macromolecules.

Examples of the water-soluble macromolecules include polyvinyl alcohol, silanol-modified polyvinyl alcohol, carboxy-modified polyvinyl alcohol, styrene-maleic anhydride copolymer or ester, butadiene-maleic anhydride copolymer, ethylene-maleic anhydride copolymer, isobutylene-maleic anhydride copolymer, polyacrylamide, polystyrene sulfonic acid, ethylene-acrylic acid copolymer, vinyl acetate-acrylic acid copolymer, oxidized starch, phosphated starch, gelatin, carboxymethyl cellulose, methyl cellulose, sodium alginate, sulfated cellulose or hydroxyethyl cellulose. As the emulsions or lattices of the hydrophobic macromolecules for use herein, examples thereof include styrene-butadiene copolymer, carboxy-modified styrene-butadiene copolymer or acrylonitrile-butadiene copolymer.

Supports which can be used in the present invention may be either transparent or opaque. Examples of opaque supports include paper, synthetic paper, aluminum metallized bases or white pigment-coated supports which are obtained from the transparent supports as described below. As the paper support, neutral paper (refer to, for example, JP-A-55-14281) is preferably for use herein due to its favorable preservability when it is in use as elapsed with time, since it is obtained by a sizing treatment with a neutral sizing agent such as an alkyl ketone dimer to obtain a pH value of from 6 to 9 as found on heat-extracting.

On the other hand, examples of transparent supports include polyester films such as polyethylene terephthalate or polybutylene terephthalate, cellulose derivative films such as cellulose triacetate films, polyolefin films such as polystyrene films, polypropylene films or polyethylene films, polyimide films, polyvinyl chloride films, polyvinylidene chloride films, polyacrylic acid copolymer films or polycarbonate films. These films may be used either alone or in the form of a laminate. Of these films, particularly preferred are such polyester films as those treated by heat-resistant treatment or antistatic treatment. The thickness of the transparent supports to be used herein ranges from 20 to 200 μm and, more preferably, from 50 to 100 μm.

In the present invention, subbing layers are preferably provided between the support and the heat-sensitive recording layers to enhance the bonding therebetween. As ingredients for use in the subbing layers, examples thereof include gelatin, synthetic macromolecular lattices or nitro cellulose. The coated amount of the subbing layers is preferred to range from 0.1 to 2.0 g/m$^2$ and, more particularly, from 0.2 to 1.0 g/m$^2$.

The subbing layers may preferably be cured by hardening agents to avoid swelling, thereof, since recorded images in heat-sensitive recording layers can be degraded by the swelling due to water contained in the heat-sensitive recording layers when the heat-sensitive recording layers are coated on the subbing layers. The hardening agents to be used herein include those such as described in, for example, JP-A-2-141279. The added amount of the hardening agents may suitably be adjusted to range from 0.20 to 3.0% of the weight of the ingredients contained in the subbing layers depending on the coating method employed herein and the desired degree of cross-linking in the layers. Accordingly, if required, the pH of the liquid (provided with the hardening agents) may be adjusted either to the alkaline side by adding, for example, sodium hydroxide or to the acidic side by adding, for example, citric acid. Moreover, anti-foaming agents for reducing foam produced during the course of coating or activating agents for avoiding a lined coat by improving the leveling in the liquid may further be applied thereto.

The surface of the support desirably undergoes activation treatment (by any known method) before subbing layers are coated onto the support. The methods for activation treatment include the etching treatment by acid, the flame treatment by gas burner, the corona discharge treatment or the glow discharge treatment. Of them, most preferably used is the corona discharge treatment because of the advantageous cost and/or conveniences (e.g., see U.S. Pat. Nos. 2,715,075, 2,846,727, 3,549,406 and 3,590,107).

The heat-sensitive recording materials in accordance with the present invention are produced, for example, by preparing first coating liquids containing microcapsules comprising electron donating dye precursors or diazo compounds, dispersed emulsions containing at least dispersed color developers, binders and other additives and then applying the coating liquids onto the support such as quality paper or the above-mentioned film by means of a coating method such as bead coating, curtain coating, bar coating, blade coating, air knife coating, gravure coating, roll coating, spray coating or dip coating, followed by drying. The heat-sensitive recording layers having a coated weight of, preferably, 2.5 to 25 g/m$^2$ on a dry basis are thus provided. To achieve improvements in color mixing prevention or suitability for the favorable production, the bead coating or curtain coating may be preferably used for multiple coating of the layers in superposition.

The coated amounts of the color forming components are preferred to range from 0.5 to 3.0 g/m$^2$ and, more particularly, from 0.8 to 2.0 g/m$^2$ as the sum of the color forming components in the respective heat-sensitive recording layers (the sum of the electron donating dye precursors and color developers or the sum of the diazo compounds and couplers).

Moreover, other coating methods may be used such as those described in U.S. Pat. Nos. 2,761,791, 3,508,947, 2,941,898 and 3,526,528 or described by Yuji Harazaki, "Coating Engineering" page 253 (published by Asakura Shoten, Japan, in 1973), to simultaneously coat two or more of the separate layers; or an appropriate coating method may be chosen depending on the coated amount, the coating speed, or the like.

If desired and necessary, various additives may be incorporated into the coating liquids to be used in the present invention unless such would be injurious to the characteristics of the coating liquids. Examples of such additives include pigment dispersants, viscosity builders, flow modifiers, anti-forming agents, deformers, parting agents or colorants. The multi-color heat-sensitive materials according to the present invention may advantageously be used in facsimiles or computer printers (which are operable at high speeds).

When photo-fixing in recording systems is applied to the materials comprising diazo compounds as the color forming agents, exposure zones for photolysis associated therewith are provided in the systems therefor. The arrangements of the exposure zones and recording heads associated therewith include two types of processes as generally classified. One process thereof involves the so-called one head multi-scanning system, wherein recording and then irradiation for photolysis are so operably repeated to a recording material that the material which once underwent recording and then irradiation for photolysis returns to the same starting position. The other process involves the so-called multi-head one scanning system. This system has multiple recording heads, wherein the number of heads is identical to that of colors to be intended for recording and between which the irradiation zone associated therewith is provided. These two processes may be combined as necessary or thermal energy which is applied to the recording heads may be varied on request.

Light sources for the photolysis are not limited. Examples of such light sources include various fluorescent lamps, xenon lamps, xenon flash lamps, mercury lamps under various pressures, flash light sources for photography or strobe light sources. To make the photo-fixing zones compact, optical fibers may be used for separating the light sources from the exposure zones. As the case may be, multi-color samples can be obtained by providing the recording materials, which are once recorded, with subsequent exposure to a fluorescent lamp to photo-fix the materials with the light primarily being in the visible light range, followed by recording the resulting materials once again.

In accordance with the present invention, the method for obtaining good multi-color images by multi-color heat-sensitive recording materials will be explained below. According to the present invention, full-colored multi-color heat-sensitive recording materials may be produced by providing, in the following order from the support side, a cyan color forming layer, a magenta color forming layer and a yellow color forming layer in superposition on one side of the support. In this case, to independently form colors each in the respective layers to make the recorded multi-color images close to natural ones, systems consisting of a coupling reaction of diazo compounds for color formation and a photo-fixing reaction, such as those described in JP-A-40192, may preferably be applied to at least two of such layers as described above.

That is, the uppermost yellow color forming layer on one side of the present material is allowed to independently produce a color through low thermal energy, followed by being photo-fixed by means of a light source which emits light having a specific wavelength and which is selectively capable of photolyzing the diazo compounds contained in the layer. Subsequently, the next uppermost magenta color forming layer is heat-recorded so as to independently produce a color through a higher thermal energy in relation to the preceding low thermal energy, followed by being photo-fixed by means of a light source which emits light over a specific wavelength and which is selectively capable of photolyzing the diazo compounds contained in the layer. Moreover, the inner cyan color forming layer (next to the magenta color forming layer) is heat-recorded to independently produce a color through a higher thermal energy in relation to the preceding higher thermal energy. In this case, the cyan color forming layer, as the lowest layer, is not necessarily photo-fixed.

In the above-described case, seven colors can be realized with a satisfactory color separation attained, since the present material enables independently the formation of cyan, magenta or yellow on one side of the support. The seven colors are cyan, magenta, yellow, blue (cyan+magenta), red (magenta+yellow), green (cyan+yellow) and black (cyan+magenta+yellow).

Incidentally, in multilayer multi-color recording materials, transparent heat-sensitive recording layers may be preferred except for the farthest layer from the side of an observer watching the images, since each of the obtained colors become brilliant. In addition, another material according to the present invention may be embodied by coating any one of the above-described three layers on the back side of the transparent support to obtain multi-colored images similar to those of the above-described material. In this case, the uppermost heat-sensitive recording layer on the opposite side to an observer watching the images does not need to be transparent.

Further, another material according to the present invention may be embodied by providing on the support any two layers selected from the group consisting of a cyan color forming layer, magenta color forming layer and yellow color forming layer to produce two or three colored images.

As readily understood by one skilled in the art, in the heat-sensitive recording materials according to the present invention, intermediate hues may suitably be reproduced by forming controlled colors each in the respective units caused by the action of suitably adjusted thermal energy each applicable thereto. The intermediate layers according to the present invention may favorably be applied to those of photographic recording materials, which have multilayer structures comprising gelatin as the main binder.

As described above in detail, multi-color heat-sensitive recording materials according to the present invention are those which exhibit neither the color mixing phenomenon nor the desensitization phenomenon even after a long period of storage under high temperatures and humid conditions and which are suitable for the favorable production, since the intermediate layers thereof according to the present invention comprise at least gelatin and/or gelatin derivatives and polyvinyl pyrrolidone and/or polyvinyl pyrrolidone derivatives.

The present invention will be explained in greater detail with reference to the following examples, but the present invention should not be construed as being limited thereto. In the examples, the parts and percents were by weight unless otherwise indicated.

EXAMPLE 1

A full-color heat-sensitive recording material was prepared which independently enables heat-recording of yellow, magenta or cyan respectively to give three colored records as follows:

(1) Preparation of cyan heat-sensitive recording layer coating liquid (Preparation of capsule liquid containing electron donating dye precursor)

1. Liquid A

Seven parts of 3-(o-methyl-p-dimethylaminophenyl)-3-(1'-ethyl-2-methylindole-3-yl)phthalide (for electron donating dye precursor) was dissolved in 20 parts of ethyl acetate, then 20 parts of alkylnaphthalene (high boiling point solvent) was added to the solution, and the mixture was made uniform by heating and stirring. Subsequently, 20 parts of a ⅓ adduct of ethylene diisocyanate/trimethylpropane was added to the solution thus produced and the resulting mixture was made uniform by stirring to prepare liquid A.

2. Liquid B

Two parts of a 2% aqueous solution of sodium dodecylsulfonate was added to 54 parts of a 6% aqueous solution of phthalized gelatin to prepare liquid B.

Liquid A was added to liquid B and the mixture was emulsified and dispersed by a homogenizer to produce a dispersed emulsion. The dispersed emulsion was mixed with 68 parts of water, and the mixture was made uniform and heated with stirring to 50° C., followed by being subjected to an encapsulation reaction for 3 hours, thereby obtaining a capsule liquid with microcapsules having the average particle diameter of 1.2 μm.

(Preparation of dispersed emulsion of electron accepting compound)

Five parts of 1,1-(p-hydroxyphenyl)-2-ethylhexane (for electron accepting compound), 0.3 parts of tricresylphosphate and 0.1 parts of diethyl maleate were dissolved in 10 parts of Ethyl acetate. The resulting solution was added to a solution obtained by mixing 50 g of 6% aqueous gelatin solution and 2 g of 2% aqueous sodium dodecylsulfonate solution and the resulting mixture was emulsified for 10 minutes by a homogenizer to obtain a dispersed emulsion of the electron accepting compound.

(Preparation of coating liquid)

A mixture of the capsule liquid containing the electron donating dye precursor/the dispersed emulsion of the electron accepting compound in the ratio of ¼ was prepared by mixing them to produce a coating liquid.

(2) Preparation of magenta heat-sensitive recording layer coating liquid (Preparation of capsule liquid containing diazo compound)

Two parts of 4-N-(2-(2,4-di-tert-amylphenoxy)-butyryl)piperazinobenzenediazoniumhexafluorophosphate (for diazo compound: photolytical with light having a wavelength of 365 nm) was dissolved in 20 parts of ethyl acetate, then 20 parts of alkylnaphthalene were added to the solution, and the mixture was made uniform by heating and stirring. 15 parts of a ⅓ adduct of xylylene diisocyanate/trimethylolpropane ( for capsule wall material ) was added to the solution thus obtained and the mixture was made uniform by stirring to produce a solution having the diazonium compound.

The resulting solution of the diazonium compound was added to a solution which was obtained by mixing 54 parts of 6% aqueous phthalized gelatin and 2 parts of 2% aqueous sodium dodecylsulfonate and the resulting mixture was emulsified and dispersed by a homogenizer to produce a dispersed emulsion. The dispersed emulsion thus obtained was mixed with 68 parts of water, and the resulting solution was heated to 40° C. with stirring, followed by being subjected to an encapsulation reaction for 3 hours, thereby obtaining a capsule liquid with microcapsules having the average particle diameter of 1.2 μm.

(Preparation of dispersed emulsion of coupler)

Two parts of 1-(2'-octylphenyl)-3-methyl-5-pyrazolone (for coupler), 2 parts of 1,2,3-triphenylguanidine, 0.3 parts of tricresylphosphate and 0.1 parts of diethyl maleate were dissolved in 10 parts of ethyl acetate. The solution thus obtained was added to a solution which was obtained by mixing 50 g of a 6% aqueous gelatin solution and 2 g of a 2% aqueous sodium dodecylsulfonate solution and the resulting mixture was emulsified by a homogenizer for 10 minutes to produce a dispersed emulsion of the coupler.

(Preparation of coating liquid)

A mixture of the capsule liquid containing the diazo compound/the dispersed emulsion of the coupler in the ratio of ⅔ was prepared by mixing them to produce a coating liquid.

(3) Preparation of yellow heat-sensitive recording layer coating liquid (Preparation of capsule liquid containing diazo compound)

Three parts of 2,5-dibutoxy-4-tolylthiobenzenediazoniumhexafluorophosphate (for diazo compound: photolytical with light having a wavelength of 420 nm) was dissolved in 20 parts of ethyl acetate, 20 parts of alkylnaphthalene (as a high boiling point solvent) was added to the solution, and the mixture was made uniform by heating and stirring. Subsequently, 15 parts of a ⅓ adduct of xylylene diisocyanate/trimethylolpropane as a capsule wall material was added to the solution thus obtained and the resulting mixture was made uniform by stirring to produce a solution of the diazo compound. The thus obtained solution of the diazo compound was added to a solution which was obtained by mixing 54 parts of a 6% aqueous phthalized gelatin and 2 parts of an aqueous sodium dodecylsulfonate and the resulting mixture was emulsified and dispersed by a homogenizer to produce a dispersed emulsion. The dispersed emulsion thus obtained was mixed with 68 parts of water and the resulting mixture was made uniform and heated to 40° C. with stirring, followed by being subjected to an encapsulation reaction for 3 hours, thereby providing a capsule liquid with microcapsules having the average particle diameter of 1.3 μm.

(Preparation of dispersed emulsion of coupler)

Two parts of 2-chloro-5-(3-(2,4-di-tert-pentyl)-phenoxypropylamino)acetoacetanilide, 1 part of 1,2,3-triphenylguanidine, 0.3 parts of tricresyl phosphate and 0.1 parts of diethyl maleate were dissolved in 10 parts of ethyl acetate. The solution thus obtained was added to a solution which was obtained by mixing 50 g of a 6% aqueous gelatin solution and 2 g of a 2% aqueous sodium dodecylsulfonate solution and the resulting mixture was emulsified by a homogenizer for 10 minutes to produce a dispersed emulsion of the coupler.

(Preparation of coating liquid)

A mixture of the capsule liquid containing the diazo compound/the dispersed emulsion of the coupler in the ratio of ⅔ was prepared by mixing them to produce a coating liquid.

(4) Preparation of the intermediate layer coating liquid

One part of a 6% aqueous solution of polyvinyl pyrrolidone (trade name PVPK 15: manufactured by Tokyo Kasei Co., Ltd., Japan) with the average molecular weight of 10,000 was added to 10 parts of a 6% aqueous solution of gelatin (trade name, #750; manufactured by Nitta Gelatin Co., Ltd., Japan) and the resulting mixture was made uniform by stirring to give an intermediate layer coating liquid.

(5) Preparation of the protective layer coating liquid

Ten g of a 40% dispersion of zinc stearate (trade name, Hydrin Z; manufactured by Chukyo Yushi Co., Ltd., Japan) was added to 100 g of a 6% aqueous solution of polyvinyl alcohol (polymerization degree: 1700; saponification value: 98%) to produce a protective layer coating liquid.

(6) Preparation of the heat-sensitive recording material

A multi-color heat-sensitive recording material was prepared by forming in superposition the following layers which were produced in the following order on one side of a polyethylene terephthalate film 75 μm in thickness by coating on a slide using a bead coating device with a slide-type hopper. The multiple layers were arranged in the following order from the support side: a cyan heat-sensitive recording layer; an intermediate layer; a magenta heat-sensitive recording layer; an intermediate layer; a yellow heat-sensitive recording layer and a protective layer. The multiple layers were then dried to give a multi-color heat-sensitive recording material.

The coated amounts (which are the amounts measured after drying) when the corresponding coating liquids were respectively applied thereto were, as shown below: 6.1 g/m$^2$ for the cyan heat-sensitive recording layer; 1.0 g/m$^2$ for the intermediate layer; 7.8 g/m$^2$ for the magenta heat-sensitive recording layer; 1.0 g/m$^2$ for the intermediate layer; 7.2 g/m$^2$ for the yellow heat-sensitive recording layer; and 2.0 g/m$^2$ for the protective layer.

From the material obtained by coating, as described above, the following specimens were respectively prepared for examining the cross sections of the layers coated therewith by a scanning electron microscope (observation of layer separation). One of the specimens was obtained immediately after producing the material and the others were obtained 24 hours and 72 hours after producing the material, respectively, under conditions where the relative humidity was 90% at 40° C. The results confirmed the fact that the layers thus produced demonstrated extremely satisfactory separation therebetween and, further, the material thus obtained was practically transparent or of optical transparency.

(7) Heat-recording

The heat-sensitive recording material thus obtained was imagewise heat-recorded in the following way using specimens prepared in the same manner as described above. The results obtained demonstrated that none of the heat-recorded specimens showed the color mixing phenomenon due to the diffusion of the respective color forming components contained in the layers therebetween.

Yellow images were recorded on the thus produced material using a Thermalhead (trade name; manufactured by Kyocera Co., Ltd., Japan) by adjusting the power and pulse width applied thereto so that the recording energy per area was 34 mJ/mm$^2$. The thus obtained material was then exposed for 10 seconds to light under an ultraviolet lamp with the emitted center wavelength of 420 nm and the power output of 40 W to photo-fix the yellow heat-sensitive recording layer recorded. Magenta images subsequently were recorded on the material thus obtained by adjusting the power and pulse width applied thereto so that the recording energy per area to the thermal head was 60 mJ/mm$^2$. The material thus obtained was then exposed for 15 seconds to light under an ultraviolet lamp with the emitted center wavelength of 365 nm and the power output of 40 W to photo-fix the magenta heat-sensitive recording layer recorded. Thereafter, cyan images were recorded on the material thus obtained by adjusting the power and pulse width applied thereto so that the recording energy per area was 83 mJ/mm$^2$.

In addition to the yellow recorded images, the magenta recorded images and the cyan recorded images, the combination of the yellow images in superposition with the magenta images produced a red color; the magenta images with the cyan images produced a blue color; the yellow images with the cyan images produced a green color; and the combination of the yellow images, the magenta images and the cyan images in superposition produced a black color. The results revealed that the present material gave sharp and highly light transmissible images and were free from cloudiness.

EXAMPLE 2

A heat-sensitive recording material was prepared in the same manner as in Example 1 except that polyvinyl pyrrolidone with the average molecular weight of 40,000 (trade name: PVPK30, manufactured by Tokyo Kasei Co., Ltd., Japan) was used in place of polyvinylpyrrolidone with the average molecular weight of 10,000 used in Example 1 as the intermediate layer. The specimens were similarly prepared therefrom (i.e., one was obtained immediately after producing the material and the others were obtained by allowing to stand for 24 hours and 72 hours respectively under conditions where the relative humidity was 90% at 40° C.), and were used to examine the cross sections of the layers coated therewith by observation under a scanning electron microscope. The results showed that the respective layers thus produced had an extremely satisfactory separation therebetween and, further, the material thus formed was practically transparent and light transmissible.

Moreover, the material thus obtained was image-wise heat-recorded in the same manner as in Example 1 using specimens similarly prepared therefrom. The results thus obtained showed that none of the specimens thus heat-recorded showed the color mixing phenomenon due to the diffusion of the respective color forming components contained therein, and they also yielded sharp and highly light transmissible images recorded and were free from cloudiness.

EXAMPLE 3

A heat-sensitive recording material was prepared in the same manner as in Example 1 except that a copolymer of vinyl pyrrolidone and vinyl acetate (in the molar ratio of 7:3) was used in place of the 6% aqueous solution of polyvinyl pyrrolidone with average molecular weight of 10,000 (trade name PVPK 15; manufactured by Tokyo Kasei Co., Ltd., Japan) used in Example 1 as the intermediate layer. The specimens were similarly prepared therefrom (i.e., one was obtained immediately after producing the material and the others were obtained by allowing to stand for 24 hours and 72 hours respectively under conditions where the relative humidity was 90% at 40° C.), and were used to examine the cross sections of the respective layers coated therewith by observation under a scanning electron microscope. The results confirmed the fact that the respective layers thus produced had an extremely satisfactory separation therebetween and, further, the heat-sensitive recording material thus obtained was practically transparent and light transmissible.

Moreover, the heat-sensitive recording material thus produced was heat-recorded in the same manner as in Example 1 using specimens similarly prepared therefrom. The results thus obtained showed that the specimens heat-recorded thereby yielded sharp and highly light transmissible images with little cloudiness (even though the specimen obtained which was allowed to stand for 72 hours under conditions where the relative humidity was 90% at 40° C. showed a slight color mixing phenomenon due to the diffusion of the color forming components contained in the recording layers therebetween).

COMPARATIVE EXAMPLE 1

A heat-sensitive recording material was prepared in the same manner as in Example 1 except that polyvinyl pyrrolidone having an average molecular weight of 1,200,000 (trade name; PVPK90, manufactured by Tokyo Kasei Co., Ltd., Japan) was used in place of the polyvinylpyrrolidone with the average molecular weight of 10,000 (trade name; PVPK 15, manufactured by Tokyo Kasei Co., Ltd., Japan) used in Example 1 as the intermediate layer. The specimens were similarly prepared therefrom (i.e., one was obtained immediately after producing the material and the others were obtained by allowing to stand for 24 hours and 72 hours respectively under conditions where the relative humidity was 90% at 40° C.), and were used to examine the cross sections of the respective layers coated therewith by observation under a scanning electron microscope. The results confirmed that the respective layers demonstrated an insufficient separation therebetween from the viewpoint of practicality, and, further, the heat-sensitive recording material thus produced was practically transparent and light transmissible.

Moreover, the heat-sensitive recording material thus produced was heat-recorded in the same manner as in Example 1 using the specimens similarly prepared therefrom. The results obtained showed that none of the specimens thus heat-recorded exhibited the color mixing phenomenon due to the diffusion of the respective color forming components contained in the recording layers therebetween, and they also yielded shaper and highly light transmissible images recorded with little cloudiness.

COMPARATIVE EXAMPLE 2

A heat-sensitive recording material was prepared in the same manner as in Example 1 except that a 6% aqueous gelatin solution was used as the intermediate layer coating liquid (which is different from the one used in Example 1). The specimens were similarly prepared from this material (i.e., one was obtained immediately after producing the material and the others were obtained by allowing to Stand for 24 hours and 72 hours respectively under conditions where the relative humidity was 90% at 40° C.), and were used to examine the cross sections of the respective layers coated therewith by observation under a scanning electron microscope. The results obtained showed that the respective layers demonstrated a satisfactory separation therebetween.

Moreover, the heat-sensitive recording material thus produced was imagewise heat-recorded in the same manner as in Example 1 using specimens similarly prepared from the material. The specimen which was allowed to stand for 72 hours under conditions where the relative humidity was 90% at 40° C. demonstrated the color mixing phenomenon, and cloudy recorded images.

COMPARATIVE EXAMPLE 3

A heat-sensitive recording material was prepared in the same manner (using the bead coating method) as in Example 1 except that a 6% aqueous solution of polyvinyl alcohol (polymerization degree: 1700; saponification value: 88%) was used as the intermediate layer coating liquid (which is different from the one used in Example 1). In addition, polyvinyl alcohol (polymerization degree: 1700; saponification value: 88%) was used in place of the gelatin used in Example 1 as the protective colloid when the electron accepting compound and the coupler were emulsified and dispersed. Furthermore, polyvinyl alcohol was used in place of the phthalized gelatin used in Example 1 in the microencapsulation, and sodium dodecylbenzenesulfonate was not used. During the heat-sensitive recording, it was found that mixing was brought about between the respective layers. In this case, the average particle diameters of the microcapsules obtained were found to be 1.1 μm for the cyan heat-recording layer, 1.3 μm for the magenta heat-recording layer and 1.4 μm for the yellow heat-recording layer, respectively. The specimens were similarly prepared from the material (i.e., one was obtained immediately after producing the material and the others were obtained by allowing to stand for 24 hours and 72 hours respectively under conditions where the relative humidity was 90% at 40° C.), and were used to examine the cross sections of the respective layers coated therewith by observation under a scanning electron microscope. The results confirmed the fact that the respective layers indicated an insufficient separation therebetween.

Moreover, the heat-sensitive recording material thus produced was imagewise heat-recorded in the same manner as in Example 1 using the specimens similarly prepared from the material. The results obtained showed that all of the specimens indicated not only an extremely poor color separation in both the yellow and magenta colors but also an insufficient cyan colored density of the recorded images.

COMPARATIVE EXAMPLE 4

A heat-sensitive recording material was prepared in the same manner as in Comparative Example 3 except that the mayer-bar coating method was used in place of the bead coating method. The specimens were similarly prepared from this material (i.e., one was obtained immediately after producing the material and the others were obtained by allowing to stand for 24 hours and 72 hours respectively under conditions where the relative humidity was 90% at 40° C.), and were used to examine the cross sections of the respective layers coated therewith by observation under a scanning electron microscope. The results obtained showed that the respective layers demonstrated a good separation therebetween.

Moreover, the heat-sensitive recording material thus produced was imagewise heat-recorded in the same manner as in Example 1 using the specimens similarly prepared from the material. The specimens which were obtained by allowing to stand for 24 hours and 72 hours respectively under conditions where the relative humidity was 40° C. demonstrated the color mixing phenomenon and cloudy recorded images.

The results obtained as described above are summarized in Table 1 below.

TABLE 1

| Sample | Immediately after preparation | | 40° C., 90%, 24 hours | | 40° C., 90%, 72 hours | |
|---|---|---|---|---|---|---|
| | Layer separation | Color mixing | Layer separation | Color mixing | Layer separation | Color mixing |
| Example 1 | ○ | ○ | ○ | ○ | ○ | ○ |
| Example 2 | ○ | ○ | ○ | ○ | ○ | ○ |
| Example 3 | ○ | ○ | ○ | ○ | ○ | Δ |
| Comparative Example 1 | Δ | ○ | Δ | ○ | Δ | ○ |
| Comparative Example 2 | ○ | ○ | ○ | ○ | ○ | x |
| Comparative Example 3 | x | x | x | x | x | x |
| Comparative Example 4 | ○ | ○ | ○ | x | ○ | x |

Note: Marks give degree of effect
○: good
Δ: intermediate
x: poor

While the invention has been described in detail and with reference to specific embodiments thereof, it will be apparent to one skilled in the art that various changes and modifications can be made therein without departing from the spirit and scope thereof.

What is claimed is:

1. A multi-color heat-sensitive recording material comprising a support having thereon at least two heat-sensitive recording layers and an intermediate layer located between said at least two heat-sensitive recording layers, wherein each of the at least two heat-sensitive recording layers comprise a colorless or pale-color color forming agent which forms color by heating, a color developer and a binder; said intermediate layer comprises gelatin or a phthalized gelatin and polyvinyl pyrrolidone or copolymers of vinyl pyrrolidone with other monomers; and wherein said polyvinyl pyrrolidone or said copolymers of vinyl pyrrolidone with other monomers has an average molecular weight of not more than 160,000, and is present in an amount of from 1 to 20 percent by weight based on the weight of said gelatin or said phthalized gelatin in the intermediate layer.

2. A multi-color heat-sensitive recording material as in claim 1, wherein said binder is said gelatin or said phthalized gelatin.

3. A multi-color heat-sensitive recording material as in claim 2, wherein said binder is present in a dried amount of from 0.5 to 5 g/m$^2$.

4. A multi-color heat-sensitive recording material as in claim 1, wherein at least one subbing layer is provided between said support and said at least two heat-sensitive recording layers.

5. A multi-color heat-sensitive recording material as in claim 1, wherein at least one protective layer is provided on said at least two heat-sensitive recording layers.

6. A multi-color heat-sensitive recording material as in claim 1, wherein said polyvinyl pyrrolidone or said copolymers of vinyl pyrrolidone with other monomers has an average molecular weight of not more than 50,000.

7. A multi-color heat-sensitive recording material as in claim 1, wherein said polyvinyl pyrrolidone or said copolymers of vinyl pyrrolidone with other monomers is present in an amount of from 3 to 10% by weight of said gelatin or said phthalized gelatin in the intermediate layer.

* * * * *